United States Patent [19]

Davis

[11] 4,295,425

[45] Oct. 20, 1981

[54] ROCKET ASSISTED PROJECTILE AND CARTRIDGE ARRANGEMENT WITH PRESSURE RELIEF SKIRT

[75] Inventor: William O. Davis, Baltimore, Md.

[73] Assignee: AAI Corporation, Cockeysville, Md.

[21] Appl. No.: 857,957

[22] Filed: Dec. 6, 1977

[51] Int. Cl.[3] ..... F42B 5/02; F42B 11/14; F42B 5/10

[52] U.S. Cl. ..... 102/326; 102/501

[58] Field of Search ..... 102/38 RA, 52, 49.1–49.7, 102/92.1–92.7, 93, 94

[56] References Cited

U.S. PATENT DOCUMENTS

| | | | |
|---|---|---|---|
| 35,824 | 7/1862 | Henry | 102/93 X |
| 1,861,054 | 5/1932 | Hadfield et al. | 102/52 |
| 2,507,878 | 5/1950 | Banning, Jr. | 102/92.6 |
| 3,277,825 | 10/1966 | Maillard | 102/52 X |
| 3,952,657 | 4/1976 | Kaltmann | 109/93 |
| 3,981,241 | 9/1976 | Ambrosini | 102/49.7 |

FOREIGN PATENT DOCUMENTS

| | | | |
|---|---|---|---|
| 22445 | 7/1921 | France | 102/92.6 |

*Primary Examiner*—Harold J. Tudor
*Attorney, Agent, or Firm*—Reginald F. Pippin, Jr.

[57] ABSTRACT

A cartridge arrangement having propellant therein and a rocket assisted projectile for firing therefrom by ignition of propellant in the cartridge case, the rocket assisted projectile having an annular securing skirt rearward of a nozzle block and surrounding rifling band, with spaced pressure equalizing vent openings in the securing skirt for pressure equalization relief during debulleting of the projectile from the cartridge case or casing.

12 Claims, 4 Drawing Figures

ROCKET ASSISTED PROJECTILE AND CARTRIDGE ARRANGEMENT WITH PRESSURE RELIEF SKIRT

This invention relates to a rocket assisted projectile arrangement and a cartridge arrangement having a rocket assisted projectile.

It has been found that, during burning of the cartridge propellant mix in a cartridge having a rocket assisted projectile employing a nozzle block, a surrounding rifling band and with an annular rear securing skirt on the projectile case or shell, the propellant gas pressures generated within the securing skirt during burning of the cartridge propellant mix may create excess hoop tension in the radially unsupported securing skirt zone during debulleting or exit of the projectile from the cartridge casing. This results in cracking or splitting of the cartridge case through hoop tension failure in the securing skirt zone.

It is an object of this invention to provide a rocket assisted projectile and a cartridge arrangement having a rocket assisted projectile, in which the problem of excess hoop tension in the securing skirt is minimized during ignition of the cartridge propellant and debulleting of the projectile from the cartridge casing.

It is a further feature to provide a rocket assisted projectile, and a cartridge incorporating such, in which a rear securing skirt of the projectile has one or more transverse vent holes formed therein rearward of a rotating band and a nozzle block of the projectile to thereby enable propellant gas venting and pressure equalization on the skirt interior/exterior as the projectile exits from the cartridge casing.

Still other objects and attendant advantages will become apparent from a reading of a preferred embodiment constructed according to the invention, taken in conjunction with the accompanying drawings, wherein.

Figure 1:
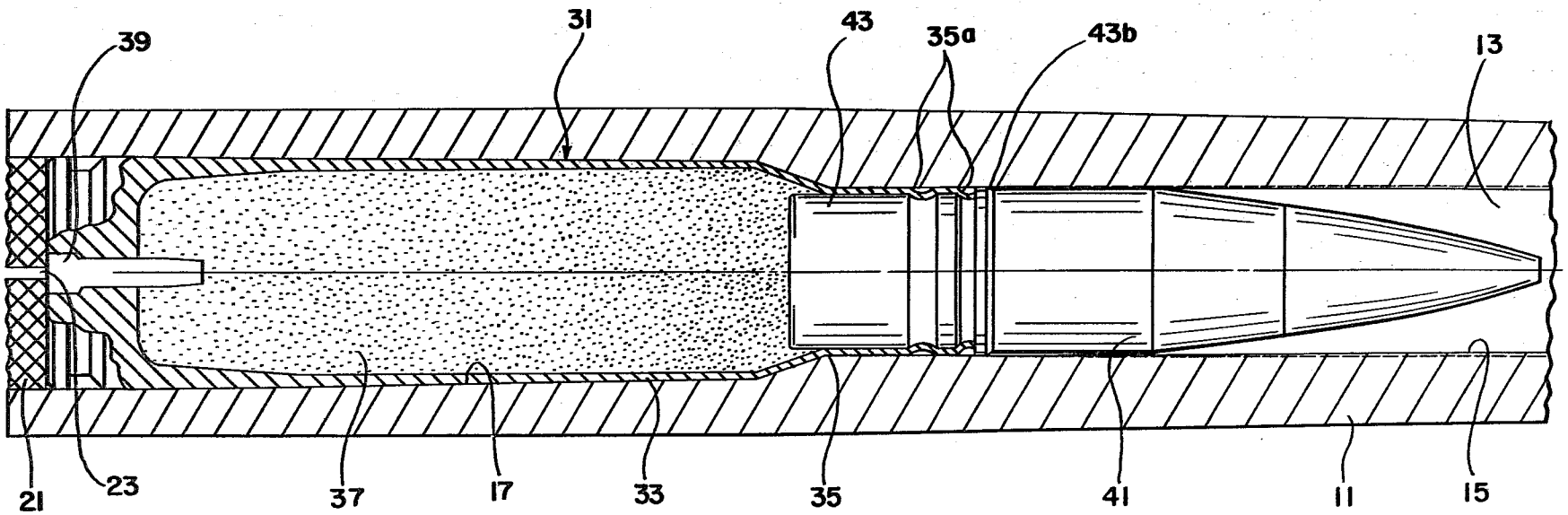
FIG. 1 is a view in partial longitudinal section of a chambered cartridge according to the invention.
Figure 2:
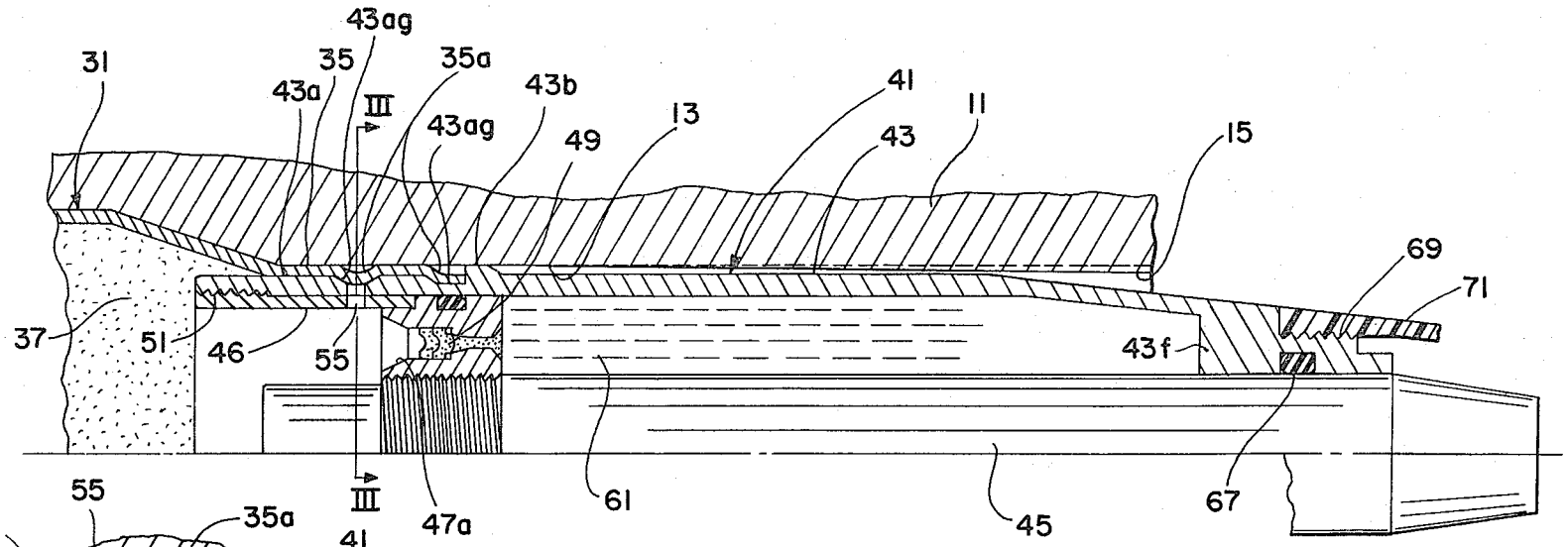
FIG. 2 is a section view in more detail of a portion of the embodiment of FIG. 1.

Referring now in detail to the Figures of the drawing, a cartridge 31 has a rocket assisted projectile 41, with ignitable propellant mix 37 within a case or casing 33 for initial propulsion of the projectile 41 and ultimate ignition of a rocket propellant grain 61 within the projectile 41.

The cartridge case 33 has a suitable percussion primer 39 which may be suitably fired by a firing pin 23 after chambering of the cartridge within a cartridge chamber 17 of a barrel 11 and closure of the bolt 21. Projectile 41 has an annular rotating band **43*b* formed on its body case 43, for engagement with the rifling 15 of the barrel bore 13**.

Projectile 41 is releasably secured within the open-mouthed forward end of cartridge case or casing 33 by annular crimping, as at **35*a*, of the casing 33 into outer annular grooves 43*ag* formed on the projectile case 43. To enable this securement, an annular securing skirt 43*a* is formed as the rear end of projectile case 43 extending rearwardly behind the rotating band 43*b* of the case 43, and the annular crimping grooves 43*ag*** are formed in its surface.

Rocket assisted projectile 41 has a generally cylindrical target penetrator of suitable high density material such as steel, tungsten, etc., substantially smaller in diameter than the outer diameter of the projectile case 43, which penetrator is carried in coaxial relation within thin-walled projectile case 43, being supported and axially secured against axial movement at its rear end by a nozzle block 47 which is fitted with an O-ring seal 57 within projectile case 43. At its forward end, which is preferably tapered for aid in target penetration, the penetrator 45 is press fit within and supported in stabilized, coaxial, rotation-imparting relation within case 43 and a tubular propellant grain 61 by a forward support block **43*f* integral with the projectile case, an O-ring 67 being employed for added sealing capability. A suitable preferably thin-walled windshield 71 may be secured over the nose end of penetrator 45 by threaded engagement, as at 69, with the forward end 43*f* of case 43**.

As an aid to retention of the nozzle block within case 43, a retaining ring or sleeve 46 is threadedly secured, as at t1, within securing skirt **43*a* and engages the rear end surface of nozzle block 47** in securing relation thereto.

Penetrator 45 is threadedly secured within and carried by nozzle block 47 in coaxial relation to the block 47 and case 43, thereby effectively securing the penetrator against longitudinal slippage relative to the nozzle block and the remainder of the projectile 41.

An end burning rocket propellant grain 61 occupies the tubular chamber formed between the projectile case 43 and penetrator 45, having a suitable burn-inhibiting coating or treatment along its radially inner and outer and forward surface to aid in assuring progressive rear end burning without undesired spurious lateral or forward end burning.

Propellant grain 61 is ignited by annularly spaced igniter delay plugs 49 secured within and initially sealing corresponding nozzle discharge openings **47*a* formed in nozzle block 47 and through which the reaction exhaust products from burning of propellant grain 61 are discharged after ignition of the propellant grain 61. The igniter plugs 49 serve to enable ignition of the end surface of rocket propellant grain 61, and are themselves ignited from contact by the hot burning gases 37*b* from the cartridge propellant mix 37 while the projectile is within the case 33 or the barrel bore 13. The igniter plugs serve both to transmit ignition to the rocket grain 61 after a time delay, and to seal the rocket propellant grain and its projectile/case/nozzle block-forming containment chamber interior from the very high propellant gas pressures resulting from firing of the cartridge propellant mix, which sealing is effective for a time delay period dependent upon the selected composition of the igniter plugs and the length thereof. This time delay is the total of the time period between ignition of the cartridge propellant mix 37, the subsequent ignition of the igniter plugs by the hot propellant gases and the ultimate burning through of the igniter plugs and ignition of the rocket propellant grain 61. Desirably, the rocket grain 61 is ignited after substantial forward travel of the projectile 41 and resultant reduction of gas pressure acting on the projectile 41, so as to minimize likelihood of improper rocket grain burning, and also to minimize the structural load bearing requirements on the projectile case 43** from internal gas pressures exerted thereon, it being noted that the internal pressures resulting from the rocket grain burning may be of the order of 2,000–7,000 psi, whereas the propellant gas burning pressures may peak as high as 50,000 psi or more and reduce thereafter as the projectile progresses down the barrel bore and ultimately exits therefrom.

Figure 4:
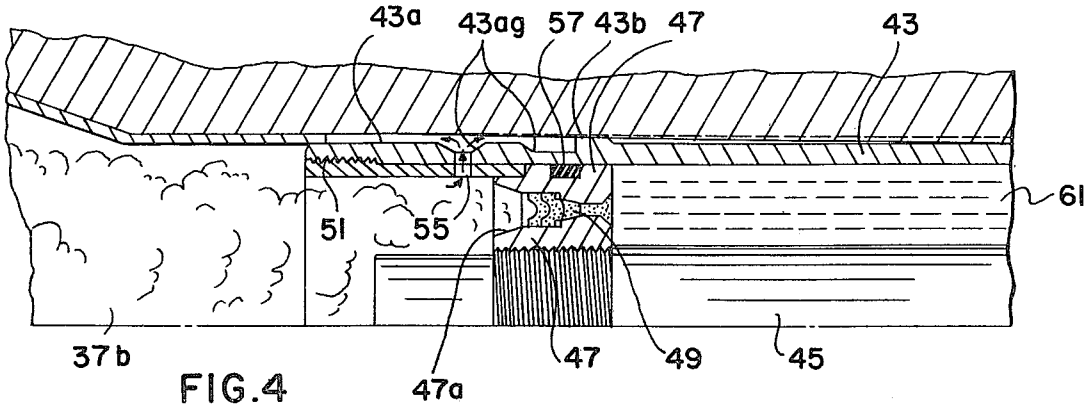
FIG. 4 is a view similar to FIG. 2, generally illustrating the debulleting or exiting of the projectile from the cartridge case.
Figure 3:
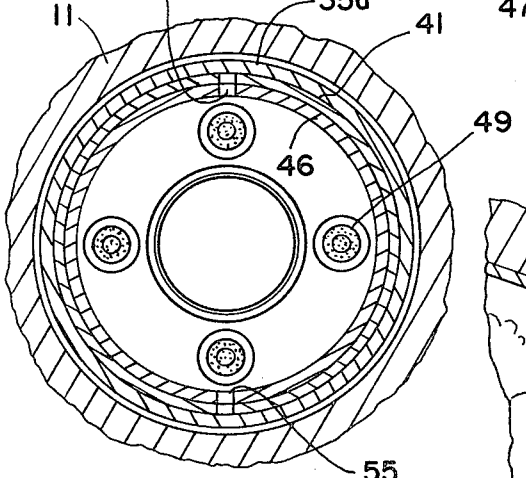
FIG. 3 is a cross section view taken on line III—III of FIG. 2.

As will be noted from FIG. 4, during debulleting or exit of the projectile 41 from the cartridge case 33, the securing skirt 43*a* at the rear end of projectile 43 slides forwardly out of the case 33, and during this forward motion the skirt 43*a* is externally unsupported radially over its progressively increasing length portion extending between the rotating band 43*b* and the forward mouth end of cartridge case 33. As a result the high pressures within the case 33 from burning of propellant mix 37 may cause sufficiently large hoop tension stresses in the case securing skirt 43*a* to crack or otherwise fail the skirt, which cracking or failure may extend to the rocket grain containment portion of the case, with obvious deficiency in operation of the projectile.

As a solution to this problem, the securing skirt 43*a* and retaining sleeve 46 have at least one radial or otherwise transverse small vent hole 55 formed therein for gas passage between the interior and exterior of skirt 43*a*. Preferably, at least two equally annularly spaced small vent holes 55 are so formed to enable laterally even and quick pressure equalization. The longitudinal position of the vent holes 55 is preferably established relative to the spacing of the gun barrel rifling 15 forward of the chambered position of the rotating band 43*b*, such that the pressurized gas venting through vent holes 55 will not occur until the rotating band 43*b* has entered the rifling, as premature leakage of propellant gas past the rotating band 43*b*, such as may occur in the barrel zone rearward of the rifling, will be detrimental to projectile performance. To this end, the distance between vent holes 55 and the rear end of securing skirt 43*a* is greater than the distance between the rotating band 43*b* and the bore rifling 15 when the cartridge is fully chambered.

While the invention has been illustrated and described with respect to a single illustrative embodiment, it will be apparent that various modifications and improvements may be made without departing from the scope and spirit of the invention. Accordingly the invention is not to be limited by the illustrative embodiment, but only by the scope of the appended claims.

I claim:

1. In a cartridge arrangement having a cartridge case containing ignitable propellant for propelling a rocket-assisted projectile and having an open forward mouth end for receiving and holding a projectile, the improvement comprising:

a rocket-assisted projectile having a casing containing a rocket propellant grain and a nozzle block rearward of said rocket grain and having a discharge nozzle therein, said projectile casing having an external rifling-engaging rotating band about a portion of the zone of said nozzle block, and an annular securing skirt extending rearwardly of said rifling band and said nozzle block and grippingly secured within and by said open forward mouth end of said cartridge case, said projectile securing skirt being of smaller diameter than said rotating band and having at least one vent hole formed therein rearward of and closely adjacent said nozzle block for pressure equalization between the interior and exterior of said skirt during exit of said projectile from said cartridge case by the ignition of said propellant mix, to thereby minimize likelihood of hoop tension cracking of said securing skirt.

2. A cartridge arrangement according to claim 1, said cartridge case being circumferentially crimped about said projectile securing skirt to grippingly releasably hold said projectile therein.

3. A cartridge arrangement according to claim 1, said projectile skirt having a plurality of annularly spaced said vent holes formed therein.

4. A cartridge arrangement according to claim 1, and a retaining ring secured within said projectile casing skirt for aid in retaining said nozzle block in place within said casing, said retaining ring having at least one vent hole therein, which vent hole connects with said vent hole in said casing.

5. A cartridge arrangement according to claim 4, said projectile skirt and retaining ring having a plurality of annularly spaced said vent holes formed therein.

6. A cartridge arrangement according to claim 1, said nozzle block having a plurality of annularly spaced discharge nozzles, and a central essentially nonburning penetrator mass extending along said projectile casing and secured within said nozzle block, said rocket grain being tubular and combustible to discharge its effluent combustion products under pressure through said discharge nozzles after ignition thereof from the burning of the propellant mix within said cartridge case.

7. A rocket assisted projectile comprising a casing containing a rocket propellant grain, a nozzle block sealingly secured in said casing rearward of said rocket grain and having a discharge nozzle therein, said casing having an external bore-rifling-engaging rotating band annularly disposed about a portion of the zone of said nozzle block, and an annular securing skirt extending rearwardly of said rotating band and said nozzle block and adapted to be grippingly secured thereby within the open forward mouth end of a cartridge case, said securing skirt being of small diameter than said rotating band and having at least one vent hole formed therein rearward of and closely adjacent said nozzle block for pressure equalization between the interior and exterior of said skirt during exit of said projectile from a cartridge case.

8. A projectile according to claim 7, said skirt having annular grooves and ridges formed therein for crimping securement thereto of a cartridge case.

9. A projectile according to claim 7, said skirt having a plurality of annularly spaced said vent holes formed therein.

10. A projectile according to claim 7, and a retaining ring secured within said casing skirt for aid in retaining said nozzle block in place within said casing, said retaining ring having at least one vent hole therein, which vent hole connects with said vent hole in said casing.

11. A projectile according to claim 10, said skirt and retaining ring having a plurality of annularly spaced said vent holes formed therein.

12. A projectile according to claim 7,
said nozzle block having a plurality of annularly spaced discharge nozzles,
and a central essentially nonburning penetrator mass extending along said projectile casing and secured within said nozzle block, said rocket grain being tubular and combustible to discharge its effluent combustion products under pressure through said discharge nozzles after ignition thereof.

* * * * *